United States Patent [19]

Papst

[11] Patent Number: 4,475,596

[45] Date of Patent: Oct. 9, 1984

[54] WELL STIMULATION SYSTEM

[76] Inventor: Wolfgang A. Papst, #2109, 727-6. Ave. SW., Calgary, Alberta, Canada

[21] Appl. No.: 462,436

[22] Filed: Jan. 31, 1983

[51] Int. Cl.[3] ..... E21B 43/24

[52] U.S. Cl. ..... 166/303; 166/59

[58] Field of Search ..... 166/59, 300, 303; 60/39.462

[56] References Cited

U.S. PATENT DOCUMENTS

| | | | |
|---|---|---|---|
| 2,680,486 | 6/1954 | Carpenter | 166/297 |
| 3,075,463 | 1/1963 | Eilers et al. | 166/299 |
| 3,230,707 | 1/1966 | Rothmayer et al. | 60/39.462 |
| 3,447,316 | 6/1969 | White | 60/39.462 |
| 3,746,088 | 7/1973 | Haskin et al. | 166/59 |
| 3,982,592 | 9/1976 | Hamrick et al. | 166/302 |
| 4,078,613 | 3/1978 | Hamrick et al. | 166/59 |

*Primary Examiner*—Stephen J. Novosad
*Assistant Examiner*—William P. Neuder

[57] ABSTRACT

The present invention relates to a process for increasing the yield of hydrocarbons from an underground hydrocarbon-bearing formation penetrated by a borehole and wherein a gas generator is located in the borehole at or above the level of the formation. The gas generator includes a housing forming a chamber and having an upper inlet end for receiving fuel, a catalyst assembly in an upper region of the chamber, a gas-generating reaction chamber below the catalyst assembly, this reaction chamber having a separate chemical reactant inlet and a restricted lower outlet for the passage of hot gaseous reaction products. The method of this invention relates to the operation of this gas generator by the steps comprising: flowing from the surface a fuel consisting of hydrogen peroxide, catalytically reacting the hydrogen peroxide to form hot reaction gases including oxygen and steam and contacting the hot reaction gases with a chemical reactant which converts the oxygen into steam, whereby hot gaseous reaction products substantially free of uncombined oxygen penetrate the hydrocarbon-bearing formation.

4 Claims, 4 Drawing Figures

WELL STIMULATION SYSTEM

This invention relates to a recovery process and system for hydrocarbons in subterranean formations penetrated by a borehole.

Due to the viscous qualities of crude oil and capillary forces affecting the movement thereof, the recovery of oil from subterranean formations is incomplete. Numerous efforts have been made to recover this residual crude oil, including the generation of hot gases and the use of heat from steam.

One such prior system is described in Haskin et al, U.S. Pat. No. 3,746,088 issued July 17, 1973. That system uses hydrogen peroxide as a reactant and produces hot gases for heating the trapped oil.

One of the problems with many of the previous systems has been the presence of hot oxygen as a component of the hot gases being injected into the formation. This hot oxygen component is capable of reacting with the carbon of the carbon steel in the tubing and actually setting the well on fire. Moreover, oxygen present in solution in fluid product obtained presents severe corrosion problems.

It is, therefore, the object of the present invention to inject into subterranean formations hot gaseous mixtures which are substantially free of oxygen.

SUMMARY OF THE INVENTION

The present invention relates to a process for increasing the yield of hydrocarbons from an underground hydrocarbon-bearing formation penetrated by a borehole and wherein a gas generator is located in the borehole at or above the level of the formation. The gas generator includes a housing forming a chamber and having an upper inlet end for receiving fuel, a catalyst assembly in an upper region of the chamber, a gas-generating reaction chamber below the catalyst assembly, this reaction chamber having a separate chemical reactant inlet and a restricted lower outlet for the passage of hot gaseous reaction products. The method of this invention relates to the operation of this gas generator by the steps comprising: flowing from the surface a fuel consisting of hydrogen peroxide, catalytically reacting the hydrogen peroxide to form hot reaction gases including oxygen and steam and contacting the hot reaction gases with a chemical reactant which converts the oxygen into steam, whereby hot gaseous reaction products substantially free of uncombined oxygen penetrate the hydrocarbon-bearing formation.

The hydrogen peroxide fuel preferably contains about 70 to 98% by weight hydrogen peroxide. The chemical reactant which contacts the hot reaction gases is preferably ammonia or hydrogen.

According to a further preferred embodiment of the invention, the borehole may be separately pressurized by means of a separate gas injected into the borehole under pressure from the surface. This separate gas may conveniently be nitrogen or carbon dioxide.

BRIEF DESCRIPTION OF THE DRAWINGS

Certain preferred embodiments of the present invention are illustrated in the attached drawings in which.

DESCRIPTION OF THE PREFERRED EMBODIMENTS

Figure 1:
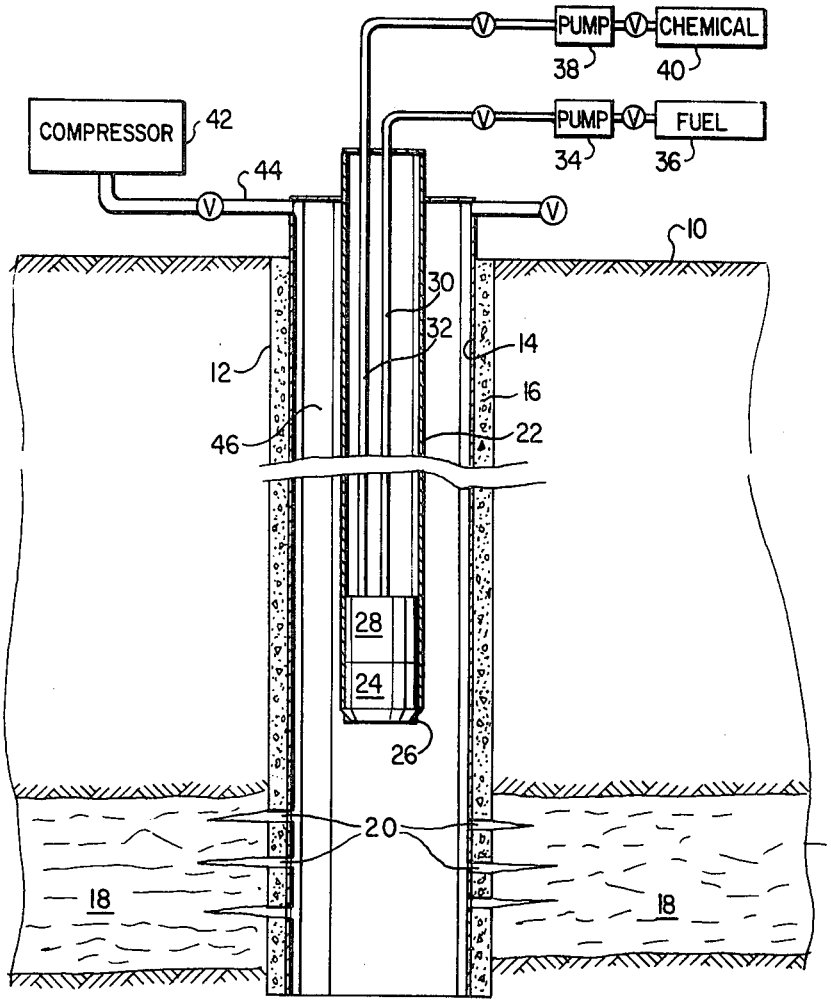
FIG. 1 schematically illustrates a gas generator located in a borehole which penetrates a hydrocarbon bearing formation according to the present invention.

Referring to FIG. 1, a borehole 12 extends from the surface 10 downwardly to a subterranean oil bearing formation 18. A casing 14 is cemented into the borehole 12 by means of an oilwell cement 16. The casing 14 extends down to the oil bearing formation 18 and includes perforations 20 permitting access to the formation.

Within casing 14 is positioned a concentric tube 22 with a landing nipple 26 at the lower end thereof. An injection check valve 24 is positioned within tube 22 directly above the nipple 26 and this prevents flow of fluids upwardly into the tube 22.

A gas generator 28 is positioned within tube 22 above check valve 24. A tube 30 extends from the gas generator 28 upwardly to pump 34 and fuel source 36. A second tube 32 extends upwardly from gas generator 28 to pump 38 and chemical reservoir 40.

The system may also include a compressor 42 for providing gas under pressure via line 44 into the annular space 46 between casing 14 and tube 22.

Figure 2:
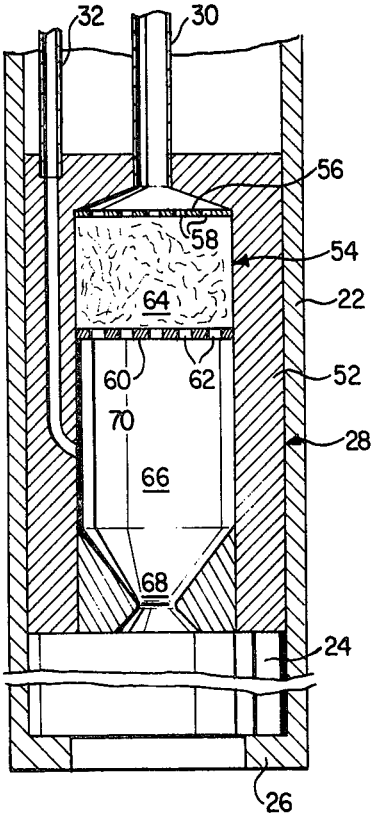
FIG. 2 is an enlarged vertical cross-sectional view of the gas generator.

The gas generator is described in greater detail in FIG. 2. It will be seen that the generator 28 includes a housing block 52 having a cavity 54 therein. This cavity 54 connects at its upper end to fuel tube 30. The upper end of cavity 54 includes a fuel distribution plate 56 with perforations 58. Spaced a distance downwardly from plate 56 is a further plate 60, also having perforations 62. The space 64 between the plates 56 and 60 forms a catalyst retaining zone.

Below plate 60 is a reaction chamber 66. The chemical inlet line 32 feeds into the reaction chamber 66 at inlet 70. The lower end of reaction chamber 66 includes a restricted outlet 68.

In operation, gas under pressure from compressor 42 is provided in the annular space 46, this gas serving to remove any fluids that may exist within the well and within the perforations 20. Fuel is then supplied from tank 36 via pump 34 and line 30 into gas generator 28. Simultaneously a reactant is supplied from tank 40 via pump 38 and line 32 to the reaction chamber 66 of the generator 28.

The fuel decomposes on contacting the catalyst in space 64 and any oxygen formed reacts in the reaction chamber 66 with the chemical reactant from line 32.

The hot gaseous reaction products substantially free of uncombined oxygen flow out through restricted outlet 68 and check valve 24 and eventually through the perforations 20 into the formation 18. The gas under pressure from compressor 42 may continue to be added to the annular space 46 throughout the formation and injection of hot gases from generator 28 and even thereafter to ensure that all hot gases generated by generator 28 enter the formation 18.

Figure 3:
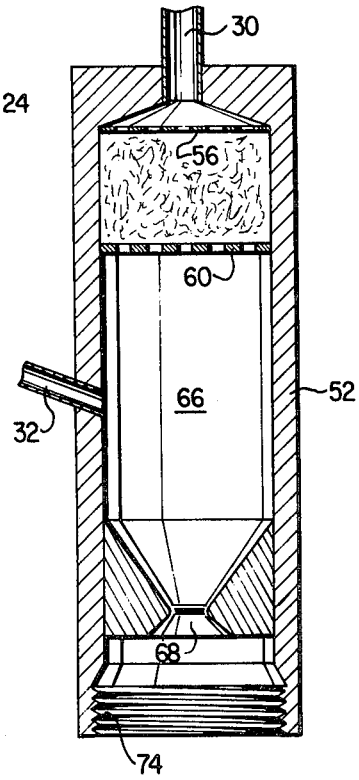
FIG. 3 is an enlarged cross-sectional view of a modified gas generator.

The arrangement shown in FIG. 3 is essentially the same as that shown in FIG. 2 except for the chemical inlet tube 32 which extends through the wall and the provision of a threaded portion 74 for connecting a lower section.

Figure 4:
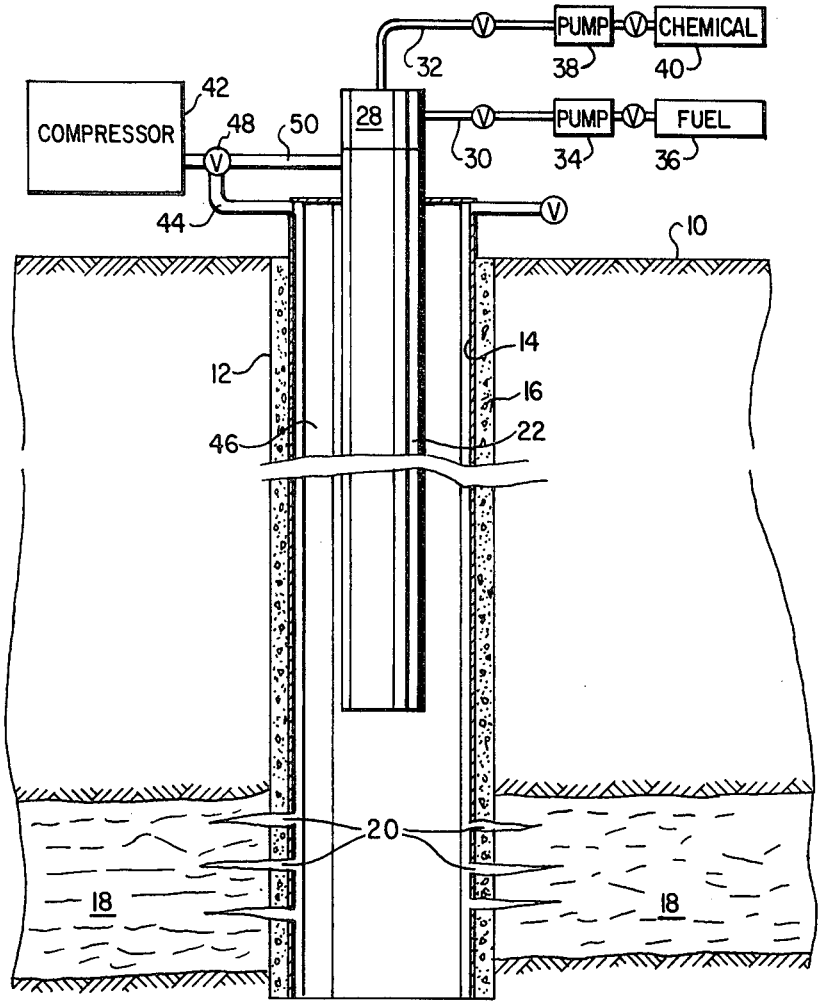
FIG. 4 schematically illustrates an alternative embodiment in which the gas generator is located at the surface.

FIG. 4 illustrates an alternative embodiment of invention in which the gas generator 28 is located at the surface. Apart from this, the system shown in FIG. 4 is generally similar to that shown in FIG. 1.

The compressor 42 is arranged to inject gas under pressure via valve 48 either through line 44 into the annular space 46 or through line 50 into tube 22. For operating this arrangement, the compressor 42 injects the gas under pressure into the annular space 46 and also into tube 22 to force any contained fluids back into the formation 18. This having been done, the flow of gas via tube 50 into tube 22 is stopped and simultaneously the flow of fuel from tank 36 and chemical from tank 40 is commenced to gas generator 28. This produces the hot gaseous reaction products substantially free of uncombined oxygen as described above which pass down through tube 22, through perforations 20 and into formation 18.

For operation of the present invention, the catalyst used in space 64 is preferably a material such as nickel, silver, chromium or manganese. The hydrogen peroxide entering via line 30, on contacting this catalyst decomposes into steam and hot oxygen. This mixture enters into the chamber 66.

If the hot oxygen were allowed to enter the oil bearing formation 18, any of the following reactions could occur depending on temperatures:

I. $O_2$+hydrocarbons→oxygen addition products

II. $O_2+2H_2 \rightarrow 2H_2O$ dehydrogenation

III. $O_2+C \rightarrow CO_2$ or CO

At relatively low temperature, the low temperature oxidation reaction (1) predominates. This reaction is known as the asphalt blowing process used to increase the viscosity and softening point of the asphalt. (See Goppel, J. M. & Knotnerus, J., "Fundamentals of Bitumen Blowing", Proc. IV World Pet. Congress, Sec. III) (also Serglyenko, S. R. & Garbalinsky, V. A., Acta Chem Hung 213, 1963). These authors demonstrate very clearly that oxygen addition reactions result in the generation of polar groups, principally esters

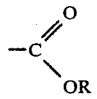

and the balance is about evenly split between carboxyl groups,

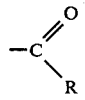

acids,

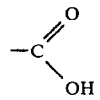

and alcohols

R—C—OH

The esterification reactions are important because they are thought to be precursors in the polymerisation step, which is responsible for the substantial increase in crude viscosity. Carboxyl groups are believed to be effective surfactants that stabilize hard to break emulsions. Oxygen addition to the asphaltic components of the crude oil will influence their polarity and reduce somewhat their solubility, which could have a very serious impact on wettability of the reservoir matrix material. (See Garon, A. M. & Wygal, R. J., "A Laboratory Investigation of Fire Water Flooding", Soc. Pet. Eng. J. (Dec. 1974)). Low temperature oxidation reactions are the most significant oxygen reactions at temperatures less than 200 deg. C. and are significant at temperatures as high as 350 deg. C. Dehydrogenation reactions of the crude (Reaction II) occur at temperatures as high as 400 deg. C. If the dehydrogenation is extensive and severe, the oil will become immobile. At temperatures higher than 400 deg. C. the combustion reactions (Reaction III) dominate.

As mentioned above, a further danger of the presence of hot oxygen is that of the oxygen reacting with the carbon of the carbon steel to actually set the well on fire. As well, the oxygen may present severe corrosion problems in the fluids produced.

In the present invention, the above problems are avoided by causing any oxygen present in chamber 66 to react with a chemical reactant capable of converting the oxygen into steam. Thus, if ammonia is introduced via line 32 into chamber 66, it reacts with the oxygen as follows:

$$4NH_3+3O_2 \rightarrow 6H_2O+2N_2$$

As a consequence, the hot gases injected into the formation 18 are superheated steam and nitrogen. These hot gases pass downwardly through the restriction 68 through check valve 24 and via perforations 20 into the formation 18.

Depending on conditions, the steam produced will be a superheated steam having a temperature in the range of about 240° to 400° C. at a pressure of up to 35 MPa. Particularly by having the gas generator 28 located close to the formation 18, this steam can be injected directly into the formation with very little heat loss.

The above detailed description of an embodiment of the invention is provided by way of example only. Details of design and construction may be modified without departing from the spirit and scope of the invention.

I claim:

1. In a process for increasing the yield of hydrocarbons from an underground hydrocarbon-bearing formation penetrated by a borehole and wherein a gas generator is located in the borehole at or above the level of said formation, said gas generator comprising:

a housing forming a chamber and having an upper inlet end for receiving fuel, a catalyst assembly in an upper region of said chamber, a gas-generating reaction chamber below said catalyst assembly, said reaction chamber having a separate chemical reactant inlet and a restricted lower outlet for the passage of hot gaseous reaction products, the method of operating said gas generator which comprises:

flowing from the surface a fuel consisting of hydrogen peroxide, catalytically reacting the hydrogen peroxide to form hot reaction gases including oxygen, and steam and contacting said hot reaction gases with ammonia which converts the oxygen into steam and nitrogen, whereby hot gaseous reaction products substantially free of uncombined oxygen penetrate the hydrocarbon bearing formation.

2. The process according to claim 1 wherein the hydrogen peroxide fuel contains 70% to 98% by weight of hydrogen peroxide.

3. The process according to claim 1 wherein the borehole is separately pressurized by means of a separate gas injected into the borehole under pressure from the surface.

4. The process according to claim 3 wherein the separate gas is nitrogen or carbon dioxide.

* * * * *